US005080200A

United States Patent [19]

Gibson

[11] Patent Number: 5,080,200

[45] Date of Patent: Jan. 14, 1992

[54] BALL SCREW ELEVATOR DRIVE SYSTEM

[75] Inventor: William H. Gibson, Aurora, Colo.

[73] Assignee: Otis Elevator Company, Farmington, Conn.

[21] Appl. No.: 605,605

[22] Filed: Oct. 30, 1990

[51] Int. Cl.[5] ..... B66B 11/02

[52] U.S. Cl. ..... 187/24; 187/26

[58] Field of Search ..... 187/17, 24, 25, 26

[56] References Cited

U.S. PATENT DOCUMENTS

| | | | |
|---|---|---|---|
| 434,372 | 8/1890 | Andersen . | |
| 491,249 | 2/1893 | Reynolds | 187/24 X |
| 1,161,255 | 11/1915 | Schnitzer . | |
| 1,901,726 | 3/1933 | Bonnet | 187/24 X |
| 1,977,484 | 10/1933 | Lagerquist et al. | 187/24 |
| 3,215,227 | 3/1963 | MacChesney | 187/24 |

FOREIGN PATENT DOCUMENTS

WO8704999 8/1987 World Int. Prop. O. .

*Primary Examiner*—Joseph E. Valenza
*Assistant Examiner*—Dean A. Reichard
*Attorney, Agent, or Firm*—William W. Jones

[57] ABSTRACT

The elevator car is suspended on cables which are entrained on a pulley, and which have ends distal of the car anchored to the hoistway floor. The pulley is journaled on an upper end of a lift tube which is telescoped into a cylindrical housing anchored to the hoistway walls. A ball screw drive is mounted inside of the lift tube and is rotated therein by a reversible DC motor housed in the hoistway pit below the ball screw. A ball nut assembly is mounted on the ball screw and fixed to the lift tube so that rotation of the ball screw results in raising and lowering the lift tube and pulley. This causes concurrent raising and lowering of the elevator car in the hoistway. An electromagnetic brake selectively acts on the DC motor to hold the elevator car in place in the hoistway at landings.

7 Claims, 2 Drawing Sheets

BALL SCREW ELEVATOR DRIVE SYSTEM

DESCRIPTION

1. Technical Field

This invention relates to a novel drive system for an elevator which uses a ball screw and ball nut drive to raise and lower the elevator car in the elevator hoistway.

2. Background Art

Ball screw drives for elevators in general are known in the prior art. U.S. Pat. Nos. 434,372 granted Aug. 12, 1890 to R. C. Andersen; 1,161,255 granted Nov. 23, 1915 to C. T. Schnitzer; 1,977,484 granted Oct. 16, 1934 to F. W. Lagerquist, et al.; and 3,217,224 granted Nov. 2, 1965 to C. M. MacChesney all disclose such systems. The prior art ball screw drives for elevators are driven by an electric motor which may be disposed in the elevator hoistway or on the elevator car. In the former case, the ball screw is rotated and the ball nut is fixed to the car whereby rotation of the ball screw in opposite directions will cause the ball nut, and the elevator car to move up and down on the ball screw. When the motor is mounted on the elevator car, it will generally be operably connected to the ball nut to rotate the latter, and the ball screw will not be rotated. Thus rotation of the ball nut which is journaled to the elevator car causes the latter to move up and down over the ball screw in the hoistway. In each of the aforesaid systems, cables may be attached to the elevator car, passed around overhead pulleys or sheaves, and attached to counterweights adjacent to the car in the hoistway. The pulleys or sheaves in this instance are not traction sheaves, but merely guide the cables between the car and counterweights.

The ball screw elevator drive systems of the prior art all require some exposure of the ball screw grooves to the hoistway environment since the ball nut will be mounted on the car, either fixed or rotatably, and the car will move up and down in the hoistway next to the ball screw. This manner of movement requires a slot or the like along any housing there might be to protect the ball screw, so that the ball nut ball bearings can engage the ball screw grooves along the entirety of the ball screw. The slot renders it difficult to maintain lubricants on the ball screw and ball nut, and also exposes the ball screw to debris from the hoistway. Another drawback which arises when the motor is mounted on the elevator car to rotate the ball nut is noise in the car from the motor and rotating ball nut. Finally, both of the prior art ball screw drive variants are enhanced by a counterweight assembly which adds to the equipment and installation expense.

DISCLOSURE OF THE INVENTION

This invention relates to an improved elevator ball screw drive assembly wherein the ball screw and ball nut assembly are contained in a sealed housing mounted in the elevator hoistway. The ball screw drive assembly raises and lowers a lift tube which telescopes into the sealed housing. A pulley or sheave is journaled on the top of the lift tube, and hoist cables which are secured to the pit floor pass over the pulley and are connected to the elevator car. An electric motor in the hoistway pit rotates the ball screw to raise and lower the lift tube and pulley, thereby raising and lowering the elevator car. Sliding seals are provided between the housing and the lift tube so that the ball screw drive mechanism is protected at all times from debris, moisture, and the like in the hoistway. A spring biased electromagnetic brake is associated with the motor, and is operable to selectively brake the motor when the elevator car is stopped at landings.

It is therefore an object of this invention to provide an elevator system employing a ball screw drive for raising and lowering the elevator car in the hoistway.

It is a further object of this invention to provide an elevator system of the character described wherein the ball screw drive is enclosed in a sealed housing in the hoistway.

It is another object of this invention to provide an elevator system of the character described wherein the ball screw drive raises and lowers a pulley in the hoistway which controls the cables attached to the elevator car thereby doubling the elevator rise for a given ball screw stroke.

It is an additional object of this invention to provide an elevator system of the character described wherein the ball screw is laterally stabilized by movable support bearings positioned in the ball screw housing.

These and other objects and advantages will become more readily apparent from the following detailed description of a preferred embodiment thereof when taken in conjunction with the accompanying drawings, in which:

BEST MODE FOR CARRYING OUT THE INVENTION

Figure 1:
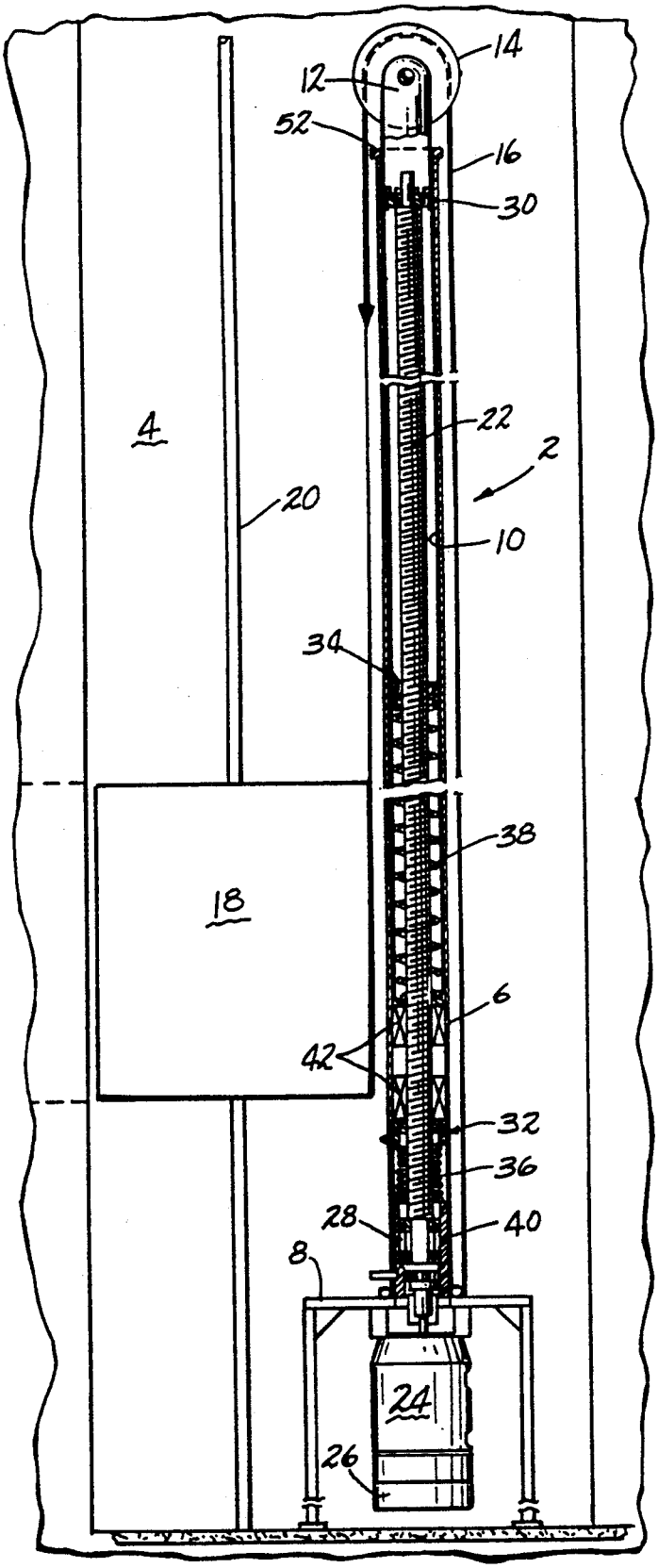
FIG. 1 is a vertical sectional view of a preferred embodiment of the invention, partially fragmented, showing the lift tube in its fully retracted position.

Referring now to the drawings, FIG. 1 shows the ball screw-lift tube assembly, denoted generally by the numeral 2, disposed in the elevator hoistway 4. The lift assembly includes a fixed tubular housing 6 which is mounted on a stand 8 in the hoistway pit. The extensible lift tube 10 is telescoped into the housing 6, and is shown in FIG. 1 in its fully-retracted position. A clevis 12 is disposed on the top end of the tube 10, and a pulley or sheave 14 is journaled in the clevis 12. The elevator cables 16 are passed over the sheave 14, with one end of the cables 16 being fixed to the stand 8 or to the hoistway floor, and the other end being fixed to the elevator car 18. The elevator car 18 is guided by guide rails 20 which are mounted on side walls of the hoistway 4.

The ball screw 22 is mounted inside the housing 6 and lift tube 10. The ball screw 22 is rotated by a reversible DC motor 24 mounted on the stand 8. The elevator car 18 is held in place at landings by a spring-operated electromagnetic brake 26 which acts on the motor 24, as will be described hereinafter in greater detail. The ball screw 22 is mounted in the housing 6 and tube 10 by lower and upper fixed bearings 28 and 30, respectively, and by lower and upper movable bearing assemblies 32 and 34, respectively. The movable bearing assemblies 32 and 34 are positioned in the housing 6 by coil springs 36 and 38, respectively. The spring 36 seats against a basal spring seat 40 and biases the lower movable bearing assembly 32 against the ball nut assembly which comprises two spaced apart ball nuts 42. The ball nuts 42 are of conventional construction the details of which are known to those skilled in the art. The spring 38 also engages the ball nut assembly to translate axial movement of the latter into axial movement of the upper movable bearing assembly 34.

Figure 2:
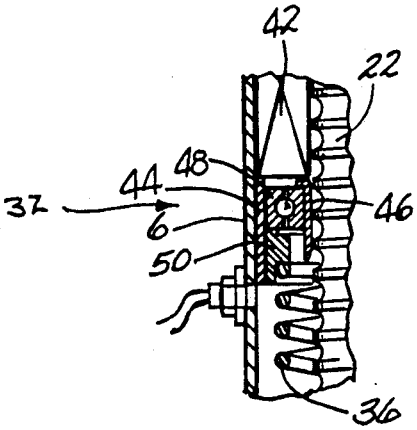
FIG. 2 is a fragmented sectional view of one of the ball screw support bearing assemblies.

Details of the moveable bearing assemblies 32 and 34 are shown in FIG. 2. Each of the bearing assemblies 32 and 34 includes an outer sleeve 44 which rides in the housing 6 or lift tube 10, and an inner sleeve 46 which engages the ball screw 22. A ball bearing 48 is interposed between the sleeves 44 and 46. A spring seat 50 is mounted in one end of the sleeves 44, 46 to provide a bearing surface for the coil springs 36 or 38. The movable bearing assemblies 32 and 34 provide support for the ball screw 22 every few feet so as to prevent whipping or lateral oscillation of the ball screw 22. The movable bearing assemblies 32 and 34 are arranged in the housing 6 and tube 10 so that they will automatically be positioned in the center of the unsupported ball screw 22 when the ball nuts 42 are at either the extreme up or down position. The ball screw 22 is thus effectively supported in a manner most effective to prevent its being whipped laterally. This advantage allows the effective length of the ball screw 22 to be increased to allow the invention to be used in a six floor installation, since the roping and pulley increase the height to which the elevator car can be lifted, as noted below.

Figure 3:
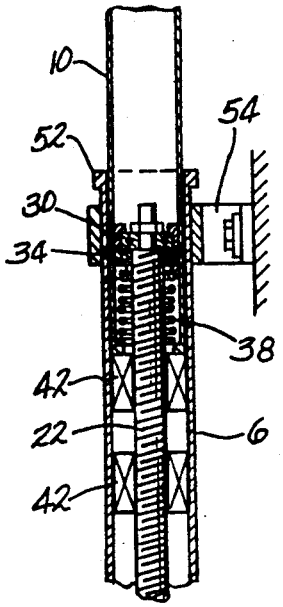
FIG. 3 is a fragmented sectional view of the upper end of the housing showing the lift tube in its fully extended condition.

The lower end of the lift tube 10 is carried by the ball nut assemblies 42 so that when the ball screw 22 is rotated in one direction, the ball nuts ride up on the ball screw 22 and in the housing 6 to raise the lift tube 10 up in the hoistway 4. This raises the sheave 14 thus lifting the elevator car 18 in the hoistway 4. A felt wiper seal 52 is mounted on the top of the housing 6 to keep the interior of the housing 6 and lift tube 10 clean, thus protecting the ball screw from the hoistway environment. The ratio of car movement to lift tube movement is preferably 2:1. FIG. 3 shows the lift tube 10 in its fully-extended position relative to the housing 6, the latter being secured to a hoistway wall by a number of brackets 54. At the fully-extended position, the ball screw 22 will have been rotated sufficiently to raise the ball nuts 42 to their uppermost limit in the housing 6, thereby lifting the movable bearing assembly 34 into contact with the fixed bearing 30, and compressing the coil spring 38. At this point, the elevator car will be at its highest point in the hoistway.

Figure 4:
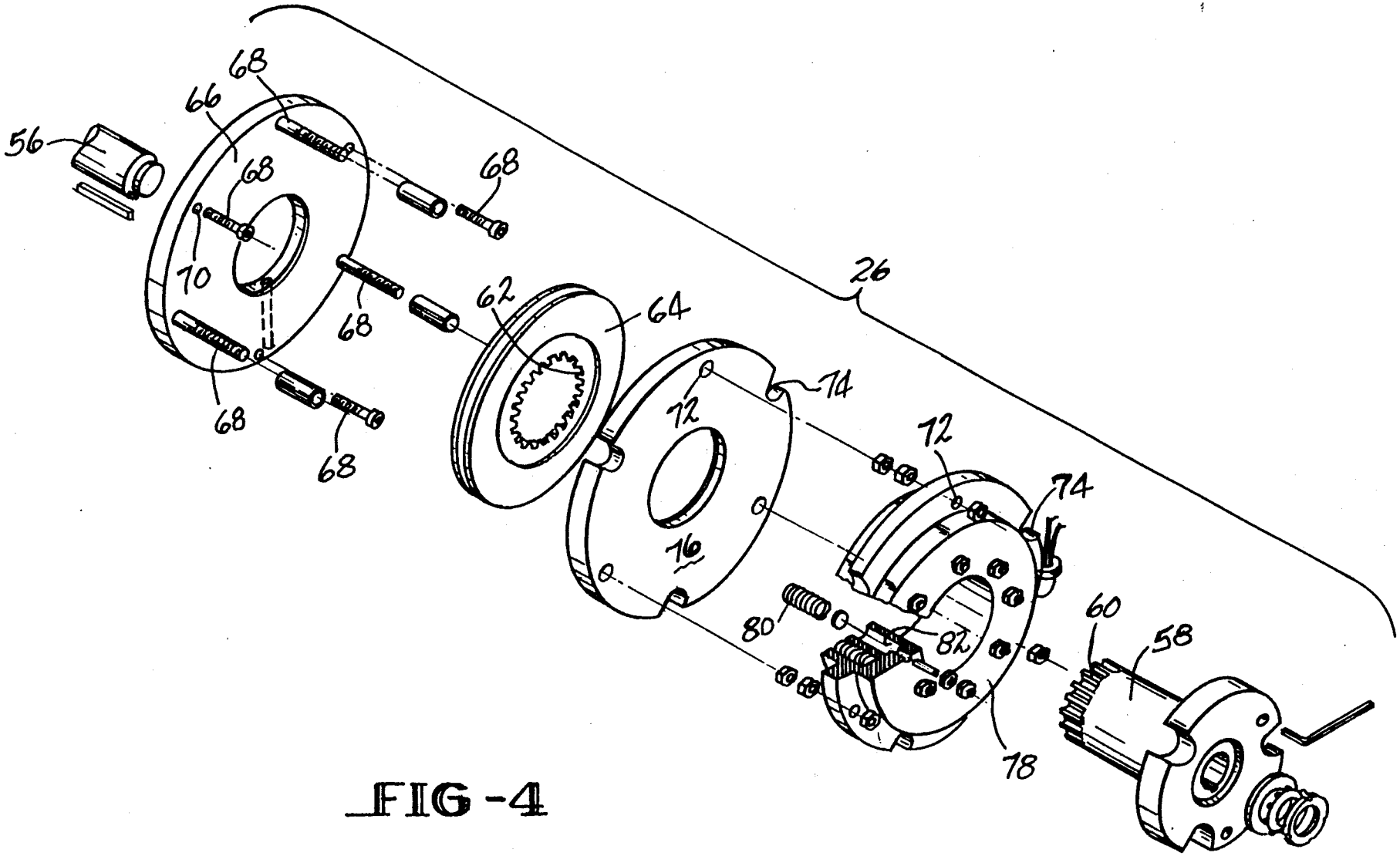
FIG. 4 is an exploded perspective view partially broken away of the brake used in the system of this invention.

Referring now to FIG. 4, details of the brake 26 used to hold the elevator car in place at landings are shown. The brake 26 is a relatively conventional spring actuated electromagnetic brake which, when energized, is "off" and when deenergized is "on". The brake 26 serves to hold the motor shaft, and thus the ball screw 22 against rotation when power to the brake is interrupted by the elevator controller (not shown). The motor shaft which drives the ball screw is denoted by the numeral 56. The motor shaft 56 is keyed into a hub 58 for concurrent rotation therewith. Multiple keys or splines can be used to provide a secure connection between the shaft 56 and hub 58. The hub 58 has a splined portion 60 which meshes with internal splines 62 on a friction disk 64. The friction disk 64 thus rotates with the shaft 56 and hub 58. A pressure plate 66 is fixed to the housing end wall of the motor 24 by means of three bolts 68 which pass through openings 70 in the pressure plate 66. A plurality of threaded studs 68' pass through aligned openings 72 in the armature plate 76 and coil assembly 78 to connect the latter parts together. Notches 74 allow access to the bolts 68. The coil 78, armature plate 76 and pressure plate 66 are all connected together in such a manner than will allow axial movement of the armature plate 76 along the hub 58, but will prevent rotational movement of the coil 78, armature 76 and pressure plate 66 by reason of their being fixed to the housing of the motor 24. A plurality of coil springs 80 are disposed in wells 82 in the coil assembly 78 for biasing the armature plate 76 toward the pressure plate 66. When the coil 78 is energized, it attracts the armature 76 and pulls the latter away from the pressure plate 66 compressing the springs 80. This allows the brake friction disk 64 to rotate with the shaft 56 and hub 58 between the armature 76 and pressure plate 66. When the elevator car stops at a landing, power to the motor 24 and coil assembly 78 is interrupted. The armature plate 76 is thus forced by the springs 80 against the friction disk 64 whereby the latter is clamped between the armature plate 76 and the pressure plate 66. The hub 58 and shaft 56 are thus held against rotation so that the ball screw 22 will remain stationary and the car will stay motionless at the landing. This condition will persist until power is once again supplied to the coil assembly 78.

It will be readily appreciated that the elevator system of this invention allows the use of a ball screw drive with protection of the drive components from the hoistway environment. The drive system is very quiet, and can be used in low rise applications in place of hydraulic elevators. Relatively few component parts are needed for the drive system, and it can operate with or without requiring a counterweight assembly.

Since many changes and variations of the disclosed embodiment of the invention may be made without departing from the inventive concept, it is not intended to limit the invention otherwise than as required by the appended claims.

What is claimed is:

1. A drive system for raising and lowering an elevator car in an elevator hoistway, said drive system comprising:

a) an elongated cylindrical housing disposed in the hoistway;

b) a lift tube telescoped into said housing for reciprocal movement therein;

c) a pulley journaled on a top end of said lift tube;

d) hoist cables disposed on said pulley and secured to the elevator car;

e) a ball screw mounted in said housing for rotational movement therein;

f) a ball nut assembly mounted on said ball screw and connected to said lift tube whereby rotation of said ball screw raises or lowers said ball nut, and thereby said lift tube in the hoistway; and g) reversible means operably connected to said ball screw to rotate the latter in either direction in said housing.

2. The drive system of claim 1 further comprising movable bearing means mounted above and below said ball nut assembly for supporting said ball screw in said housing, said movable bearing means sliding up and down said ball screw in response to movement of said ball nut assembly along said ball screw.

3. The drive system of claim 2 further comprising spring means biasing each of said movable bearing means away from said ball nut assembly.

4. The drive system of claim 2 further comprising fixed bearing means supporting upper and lower ends of said ball screw in said housing.

5. The drive assembly of claim 1 further comprising seal means sealing an upper end of said housing with said lift tube to protect said ball screw from the hoistway environment.

6. The drive assembly of claim 1 wherein ends of said hoist cables distal of said elevator car are affixed to the hoistway.

7. The drive assembly of claim 1 wherein said reversible means is an electric motor, and further comprising electromagnetic brake means operable to brake said motor when the car is stopped at a landing.

* * * * *